US011602179B2

(12) United States Patent
Liu

(10) Patent No.: US 11,602,179 B2
(45) Date of Patent: Mar. 14, 2023

(54) ELECTRONIC CIGARETTE

(71) Applicant: Shenzhen Eigate Technology Co., Ltd., Shenzhen (CN)

(72) Inventor: Tuanfang Liu, Shenzhen (CN)

(73) Assignee: SHENZHEN EIGATE TECHNOLOGY CO., LTD., Shenzhen (CN)

( * ) Notice: Subject to any disclaimer, the term of this patent is extended or adjusted under 35 U.S.C. 154(b) by 230 days.

(21) Appl. No.: 16/931,477

(22) Filed: Jul. 17, 2020

(65) Prior Publication Data

US 2022/0015453 A1 Jan. 20, 2022

(51) Int. Cl.

| | |
|---|---|
| ***A24F 40/60*** | (2020.01) |
| ***A24F 40/50*** | (2020.01) |
| ***A24F 40/40*** | (2020.01) |
| ***A24F 40/10*** | (2020.01) |

(52) U.S. Cl.

CPC ..... *A24F 40/60* (2020.01); *A24F 40/40* (2020.01); *A24F 40/50* (2020.01); *A24F 40/10* (2020.01)

(58) Field of Classification Search

CPC ..... A24F 40/50; A24F 40/40; A24F 40/49

See application file for complete search history.

(56) References Cited

U.S. PATENT DOCUMENTS

| | | | | |
|---|---|---|---|---|
| 2015/0150306 | A1* | 6/2015 | Chen | H05B 3/40 131/329 |
| 2017/0042228 | A1* | 2/2017 | Liu | A24F 40/50 |
| 2018/0013175 | A1* | 1/2018 | Liu | H02J 7/00 |

* cited by examiner

*Primary Examiner* — Anthony Calandra

(74) *Attorney, Agent, or Firm* — Matthias Scholl P.C.; Matthias Scholl

(57) ABSTRACT

An electronic cigarette including an atomization assembly and a base assembly. The atomization assembly is disposed on the battery assembly. The battery assembly includes a switch control unit. The switch control unit includes a control panel and a button. The control panel includes a power-on control circuit and a power-off control circuit which are electrically connected to the button. The battery assembly is switchable between a lock state and an unlocked state under the control of the button.

3 Claims, 5 Drawing Sheets

ELECTRONIC CIGARETTE

BACKGROUND

The disclosure relates to an electronic cigarette.

The power button of known electronic cigarettes is often touched by accident, triggering the battery of the electronic cigarettes to work unexpectedly.

SUMMARY

The disclosure provides an electronic cigarette comprising an atomization assembly and a base assembly. The atomization assembly is disposed on the battery assembly. The battery assembly comprises a switch control unit. The switch control unit comprises a control panel and a button; the control panel comprises a power-on control circuit and a power-off control circuit which are electrically connected to the button. The battery assembly B is switchable between a lock state and an unlocked state under the control of the button.

The switch control unit further comprises a cap, a battery, and a silicone gasket; the battery comprises an output end connected to an input end of the control panel to supply power to the control panel; the silicone gasket is disposed on a power button of the control panel; the cap is disposed on the silicone gasket; and the button is disposed on the cap to open or lock the device.

The atomization assembly is disposed on the battery assembly; the atomization assembly comprises a magnet and the battery assembly comprises a stainless steel adsorbing on the magnet.

DETAILED DESCRIPTION

To further illustrate, embodiments detailing an electronic cigarette are described below. It should be noted that the following embodiments are intended to describe and not to limit the disclosure.

Figure 1:
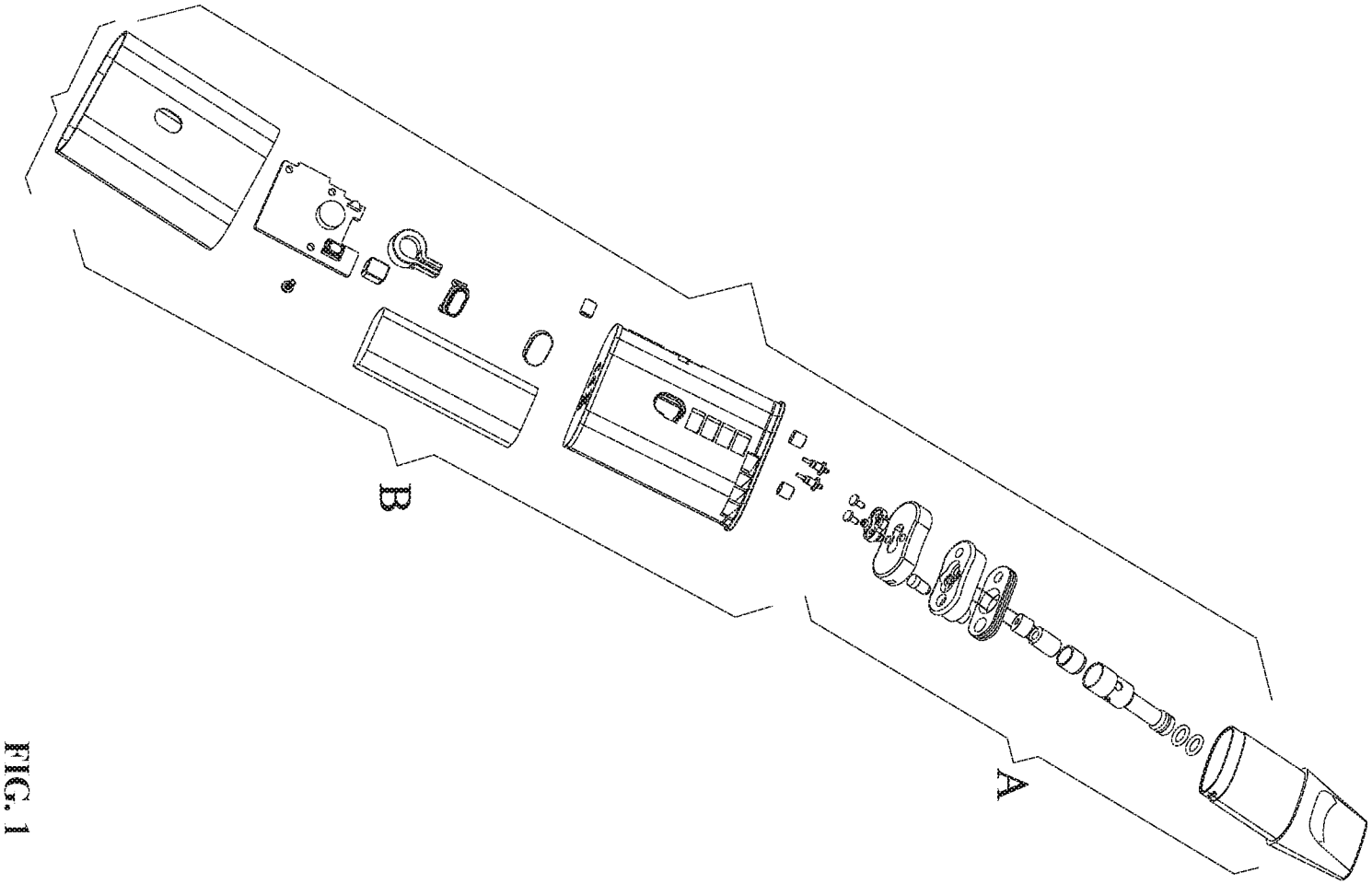
FIG. 1 is an exploded view of an electronic cigarette according to one embodiment of the disclosure.
Figure 2:
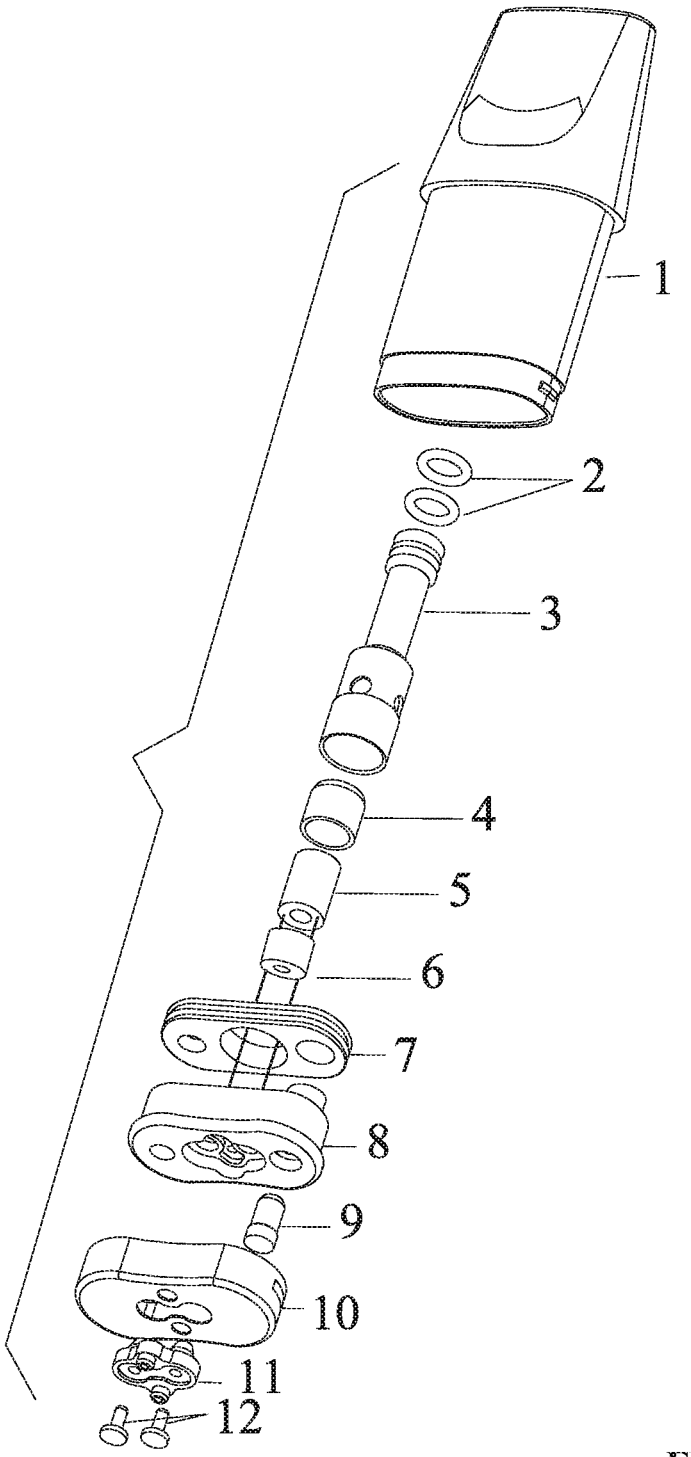
FIG. 2 is an exploded view of an atomization assembly of an electronic cigarette in FIG. 1.
Figure 3:
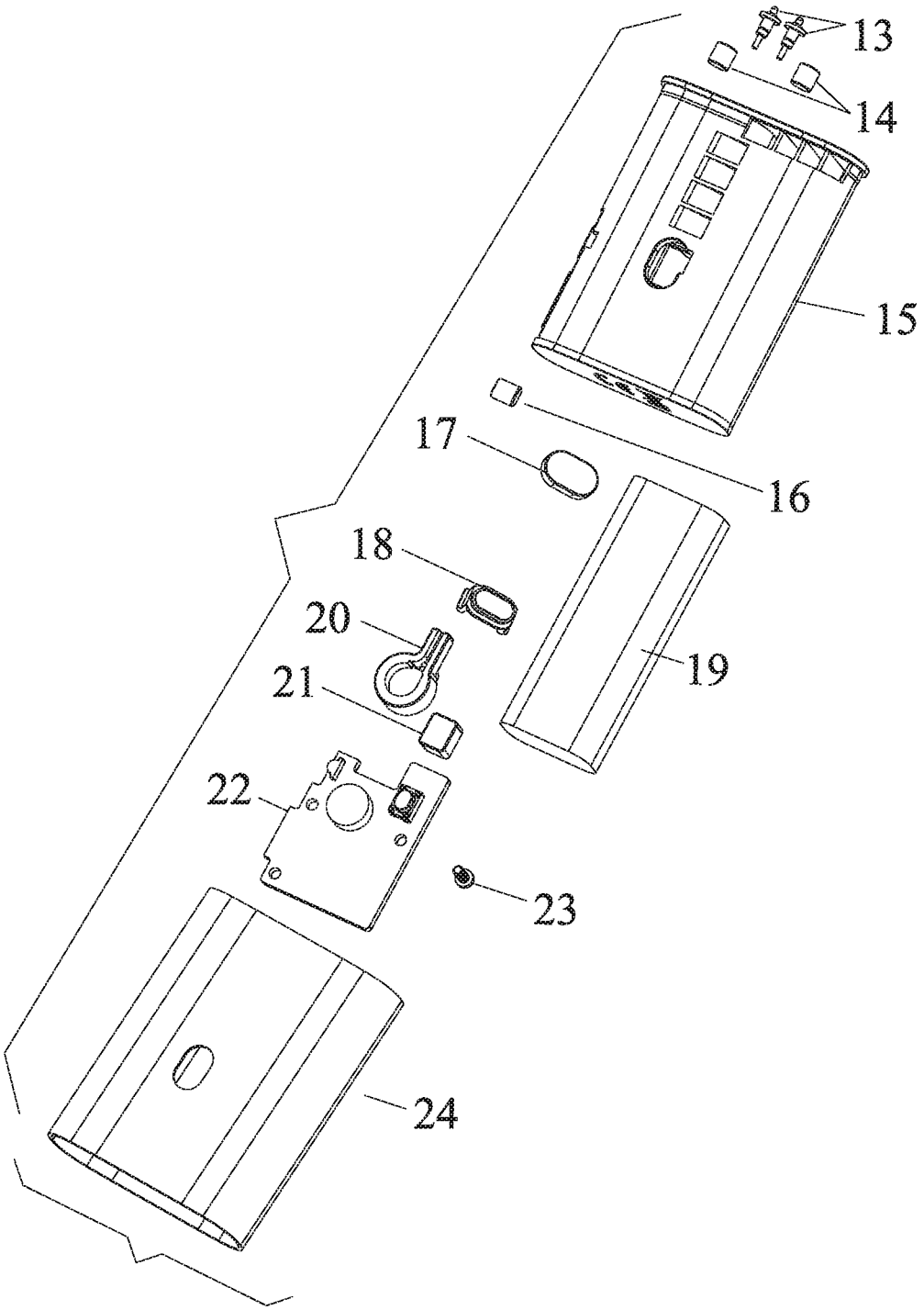
FIG. 3 is an exploded view of a battery assembly of an electronic cigarette in FIG. 1.
Figure 4:
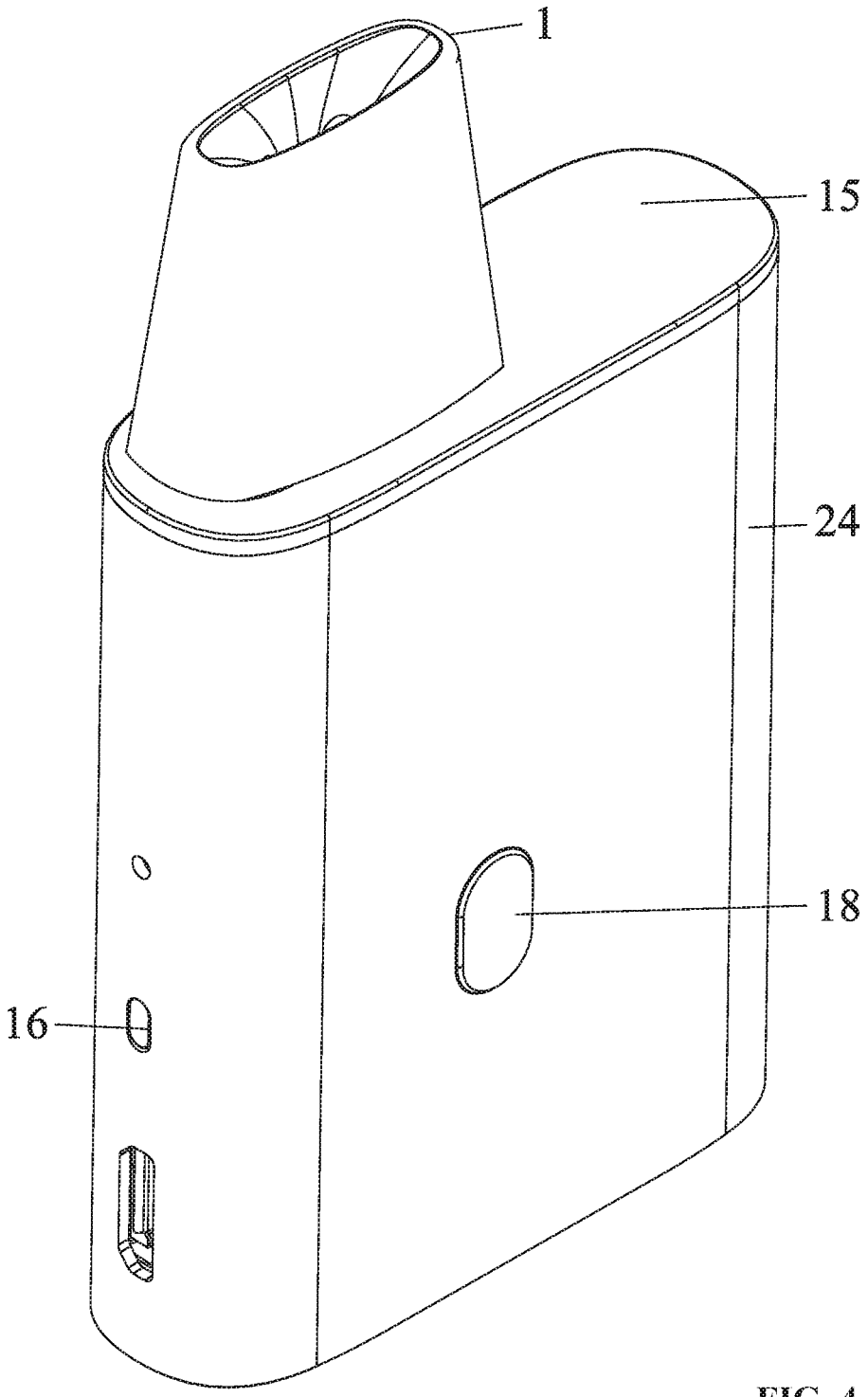
FIG. 4 is a schematic diagram of an electronic cigarette according to one embodiment of the disclosure.
Figure 5:
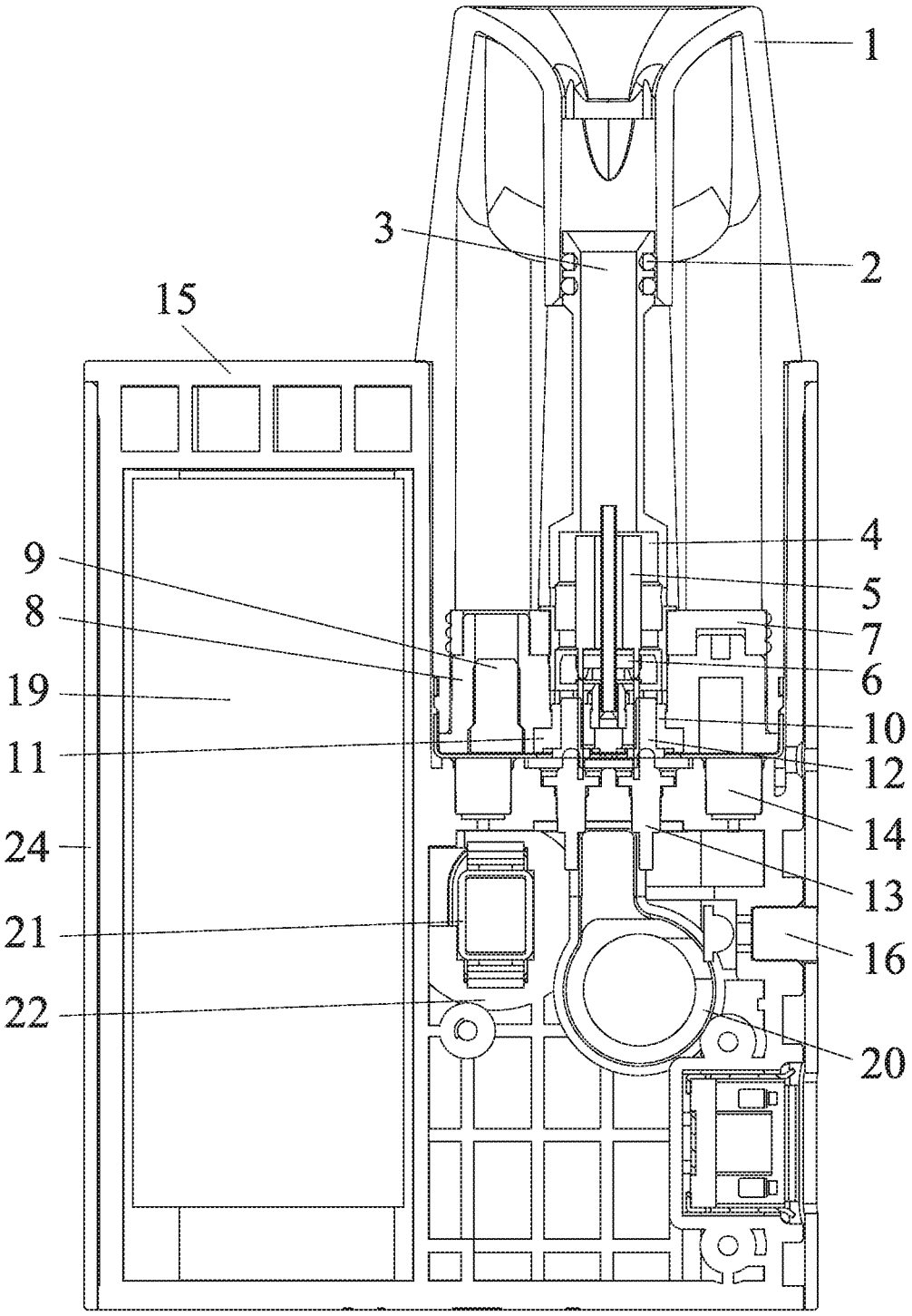
FIG. 5 is a sectional view of an electronic cigarette according to one embodiment of the disclosure.

As shown in FIGS. 1-5, an electronic cigarette comprises an atomization assembly A and a battery assembly B. The atomization assembly A is disposed on the battery assembly B.

The atomization assembly A comprises an e-liquid tank 1, a first seal ring 2, a limit cover 3, a second seal ring 4, a ceramic core 5, a piece of cotton 6, a seal gasket 7, a base cover 8, a seal plug 9, a stainless steel 10, a silicone pad 11, and a joint 12. The first seal ring 2 is disposed on the top of the limit cover 3. The second seal ring 4 is disposed on the ceramic core 5. The piece of cotton 6 is disposed on the bottom of the ceramic core 5. The second seal ring 4, the ceramic core 5, and the piece of cotton 6 are disposed in the limit cover 3. The seal gasket 7 is wrapped around the base cover 8. The limit cover 3 is disposed on the seal gasket 7.

The joint 12 is inserted in the silicone pad 11. The seal plug 9 is inserted in the base cover 8. The base cover 8 is disposed in the c-liquid tank 1, and the stainless steel 10 is wrapped around the base cover and is disposed on the bottom of the e-liquid tank 1.

The battery assembly B comprises a spring contact 13, a magnet 14, a support frame 15, a lampshell 16, a cap 17, a button 18, a battery 19, a silicone ring 20, a silicone gasket 21, a control panel 22, a bolt 23, and a housing 24. The spring contact 13 and the magnet 14 are disposed on the top of the support frame 15 for electric conduction and connection to the atomization assembly. The battery 19 comprises an output end connected to an input end of the control panel 22 to supply power to the control panel 22. The silicone ring 20 is disposed on a pneumatic switch on the control panel 22. The silicone gasket 21 is disposed on a power button of the control panel 22 to protect the power button and exhibits insulation function. The cap 17 is disposed on the silicone gasket 21 to ensure the stress balance when the power button is pressed. The button 18 is disposed on the cap 17. The control panel 22 is disposed in the support frame 15 and is fixed by the bolt 23. The support frame 15 is disposed in the housing 24. The lampshell 16 passes through the openings of the housing 24 and the support frame 15 and is fixed on an LED light element on the control panel 22, to gather and transmit the light out of the battery.

The battery assembly B comprises a switch control unit. The control panel 22 is disposed in the switch control unit. The control panel 22 comprises a power-on control circuit and a power-off control circuit which are electrically connected to the button 18. The battery assembly B is switchable between a lock state and an unlocked state under the control of the button.

The atomization assembly is disposed on the battery assembly. The atomization assembly is mechanically connected to the battery assembly through the adsorption of the magnet and the stainless steel. The battery assembly comprises a switch control unit. Repeatedly pressing the button, for example, 5 times, the switch control unit can lock the battery and no power is output; thereafter, repeatedly pressing the button again, for example, 5 times, the switch control unit can unlock the battery to output the power, thus preventing the unexpected power output of the battery.

It will be obvious to those skilled in the art that changes and modifications may be made, and therefore, the aim in the appended claims is to cover all such changes and modifications.

What is claimed is:

1. A device, comprising: an atomization assembly and a battery assembly; the atomization assembly being disposed on the battery assembly and comprising an e-liquid tank, a limit cover, a ceramic core, a piece of cotton, a seal gasket, a base cover, a seal plug, a stainless steel, a silicone pad, and a joint the battery assembly comprising a switch control unit, a support frame, a housing, and two magnets;

wherein:

the limit cover is disposed in the e-liquid tank and on the seal gasket;

the piece of cotton is disposed at a bottom of ceramic core;

the ceramic core, and the piece of cotton are disposed in the limit cover;

the seal gasket is disposed on the base cover;

the base cover is disposed at an end of the e-liquid tank;

the seal plug is inserted into a hole of the base cover;

the silicone pad is disposed in the base cover;

the joint is inserted into a hole of the silicone pad;

the stainless steel is wrapped around the base cover;

the two magnets are disposed on a top end of the support frame, and are disposed in a position away from an axis of the ceramic core;

the support frame is disposed in the housing; and the switch control unit comprises a control panel and a button; the control panel is disposed in the support frame, and comprises a power-on control circuit and a power-off control circuit which are electrically connected to the button; and the battery assembly is switchable between a lock state and an unlocked state under the control of the button.

2. The device of claim 1, wherein the switch control unit further comprises a cap, a battery, and a silicone gasket; the battery comprises an output end connected to an input end of the control panel to supply power to the control panel; the silicone gasket is disposed on a power button of the control panel; the cap is disposed on the silicone gasket; and the button is disposed on the cap to open or lock the device.

3. An electronic cigarette comprising: a battery assembly, and an atomization assembly disposed on the battery assembly; the atomization assembly comprising an e-liquid tank, a first seal ring, a limit cover, a second seal ring, a ceramic core, a piece of cotton, a seal gasket, a base cover, a seal plug, a stainless steel shell, a silicone pad, and a joint; the battery assembly comprising a spring contact, two magnets, a support frame, a lampshell, a cap, a button, a battery, a silicone ring, a silicone gasket, a control panel, a bolt, and a housing;

wherein:

the limit cover is disposed in the e-liquid tank and on the seal gasket;

the first seal ring is disposed on the limit cover;

the second seal ring is disposed on the ceramic core;

the piece of cotton is disposed at a bottom of ceramic core;

the second seal ring, the ceramic core, and the piece of cotton are disposed in the limit cover;

the seal gasket is disposed on the base cover;

the base cover is disposed at an end of the e-liquid tank;

the seal plug is inserted into a hole of the base cover;

the silicone pad is disposed in the base cover;

the joint is inserted into a hole of the silicone pad;

the stainless steel shell is wrapped around the base cover;

the spring contact and the two magnets are disposed on a top end of the support frame, and the two magnets are disposed in a position away from an axis of the ceramic core;

the battery comprises an output end connected to an input end of the control panel to supply power to the control panel;

the silicone ring is disposed on a pneumatic switch on the control panel;

the silicone gasket is disposed on the control panel;

the cap is disposed on the silicone gasket;

the button is disposed on the cap;

the control panel is disposed in the support frame and is fixed by the bolt;

the support frame is disposed in the housing; and the lampshell is fixed on an LED light on the control panel.

* * * * *